United States Patent [19]

Schmaldienst et al.

[11] 3,993,031

[45] Nov. 23, 1976

[54] ELECTRONIC MAGNETO IGNITION SYSTEM WITH ENGINE SPEED LIMITING

[75] Inventors: Peter Schmaldienst, Nurnberg; Werner Meier, Schwabach; Georg Haubner, Berg; Jurgen Wesemeyer, Nurnberg-Reichelsdorf, all of Germany

[73] Assignee: Robert Bosch G.m.b.H., Stuttgart, Germany

[22] Filed: Apr. 23, 1975

[21] Appl. No.: 570,838

[30] Foreign Application Priority Data

Apr. 24, 1974 Germany ..... 2419776

[52] U.S. Cl. ..... 123/118; 123/148 CC

[51] Int. Cl.[2] ..... F02P 1/00

[58] Field of Search ..... 123/198 DC, 118, 148 MC

[56] References Cited

UNITED STATES PATENTS 3,703,889 11/1972 Bodig ..... 123/118

3,863,616 2/1975 Wood ..... 123/118

3,875,915 4/1975 Anderson ..... 123/118

*Primary Examiner*—Charles J. Myhre

*Assistant Examiner*—Ronald B. Cox

*Attorney, Agent, or Firm*—William R. Woodward

[57] ABSTRACT

By means of an auxiliary voltage the semi-conductor controlled rectifier of a capacitor discharge magneto ignition system is at some limiting speed of the engine kept in its conducting condition from a time before the initiation of a charging halfwave until at least after the end of the charging halfwave. The auxiliary voltage is derived from a halfwave of polarity opposite to that which charges the ignition capacitor, and acts through a transistor to keep the SCR continuously conducting while the overspeed condition continues. The overspeed limit will be determined by the bias applied to the transistor.

4 Claims, 2 Drawing Figures

ELECTRONIC MAGNETO IGNITION SYSTEM WITH ENGINE SPEED LIMITING

Figure 1:
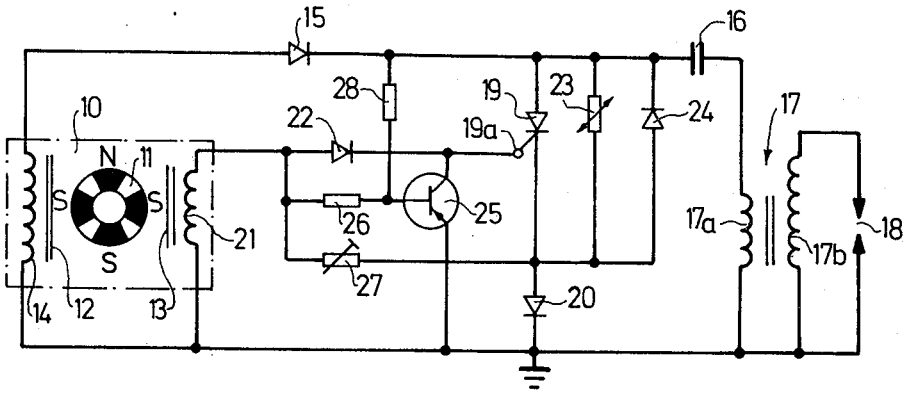

This invention relates to an electronically controlled magneto ignition system for internal combustion engines of the capacitor discharge type in which the ignition system is provided with a control operating on the electronic switching element of the ignition system for limiting the speed of the engine.

When the engine is running, in an ignition system of the type just mentioned, periodic pulses generated in the magneto generator in the form of charging halfwaves are stored in the ignition capacitor. At the moment in which spark ignition is required for the engine, the stored energy is suddenly discharged through the primary winding of the spark coil and a high voltage pulse is thereby induced in the secondary winding thereof. The latter is connected in circuit with a spark plug in which the desired spark is produced.

Internal combustion engines of small cylinder volume do not develop their power until they reach very high speeds. Such engines with high power-to-weight ratio are preferred for portable devices such as chain saws, chopping machines, sprayers, boat motors and many similar devices. Particularly in the case of new machines that have not yet had their preliminary running-in, operation at excessive speed involves the danger that the pistons of the machine will jam.

In order to prevent excessive speed it is known to equip ignition systems with speed limiting means. Thus, it is known in the case of the so called capacitor ignition systems to arrange that when a particular maximum speed of a machine is reached, the ignition capacitor is no longer sufficiently charged, or to arrange to discharge it prematurely. A portion of the ignition energy is in this case diverted over a circuit lying in parallel to the ignition capacitor so that at the actual ignition moment no energy, or insufficient energy, remains charged in the capacitor and in this way, the ignition is taken out of operation (see German D-OS No. 1,954,874).

The solution just described has shown, however, that the speed limiting thus provided does not take place at a defined maximum r.p.m., but it can actually impair operation appreciably over a more or less wide speed range below the highest permissible speed, in which range the ignition disabling takes place or the energy available to the spark plugs is reduced, thereby reducing the efficiency of the engine in an undesirable way.

In another known speed limiting arrangement, a capacitor ignition system the semi-conductor controlled rectifier in the discharge circuit of the capacitor is no longer switched into its conducting condition when the maximum permissible speed is exceeded, so that the charge remains on the capacitor and ignition is fully disabled (see U.S. Pat. No. 3,383,555).

In this type of speed limiting the ignition capacitor can be charged to very high voltages of considerable danger to the ignition system, as a result of periodic charging, so that additional special precautions are required to limit the voltage rise at the capacitor to a permissible maximum value. A further disadvantage of this ignition system is to be seen in the fact that the speed limiting as well as the control of the semi-conductor controlled rectifier takes place through a mechanically actuated interruptor contact, which is sensitive to disturbing influences and must be given maintenance care.

It is an object of the present invention to provide a suitable speed limiting arrangement for electronically controlled magneto ignition systems that will be maintenance free and will operate with high accuracy and, furthermore, one that can be provided as an addition or modification to an existing electronically controlled ignition system.

SUBJECT MATTER OF THE PRESENT INVENTION

Briefly, when the engine speed exceeds a maximum permissible speed an auxiliary voltage is applied before the beginning of an output halfwave of the magneto generator to put the electronic switching element of the ignition circuit into the conducting condition and the application of the auxiliary voltage is continued at least until the end of the aforesaid halfwave to prevent the storage of energy in the storage means of the ignition system, which is usually a capacitor.

The auxiliary voltage is derived from a halfwave of polarity opposite to that which charges the ignition capacitor and acts through a transistor to keep the SCR serving as the electronic switching means continuously conducting while the overspeed condition continues. The overspeed limit in that case is determined by the bias supplied.

Figure 2:
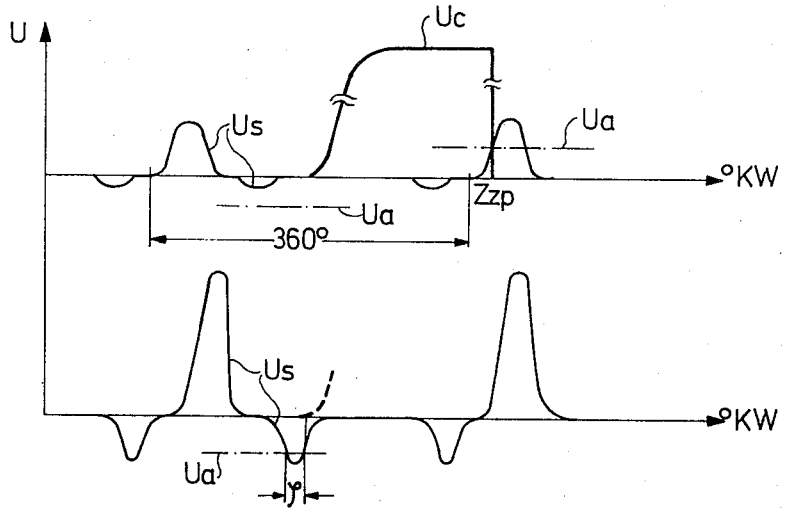

The invention is described in further detail by way of example with reference to the accompanying drawings, in which:

FIG. 1, is a circuit diagram of a magneto ignition system of the capacitor discharge type in which engine speed limiting is obtained by intermittently switching on the electronic switching element of the circuit immediately before the beginning of a charging halfwave applied to the capacitor; and FIG. 2, is a graph showing the course of the control voltage and of the capacitor voltage both in the middle speed range and upon reaching the maximum speed;

The capacitor discharge ignition system shown in FIG. 1 serves to provide ignition of an internal combustion engine not shown in the drawings that drives the magneto generator 10, that supplies electrical power for the ignition system. The magneto generator 10 consists of a pole wheel 11 driven by the engine, a charging voltage armature 12 and a control armature 13. The pole wheel 11 is unsymmetrically magnetized, having three south poles and one north pole. The charging output armature 12 has a charging winding 14 that is connected at one end over a charging circuit diode 15 with one terminal of ignition capacitor 16, which is the energy storage means of the system. The other end of the charging winding 12 is grounded to the chassis of the engine. The ignition capacitor 16 is connected in series with the primary winding 17*a* of an ignition transformer or spark coil 17, which has a secondary winding 17*b*, that has one end that is grounded like the free end of the primary winding 17*a* and the other connected with a spark plug 18, the outer electrode of which is likewise grounded to the engine chassis. In parallel to the series circuit formed by the ignition capacitor 16 and primary winding 17*a* is a semiconductor controlled rectifier 19, that operates as the electronic switch of the ignition circuit. The semi-conductor controlled rectifier (SCR) has its anode connected to the ignition capacitor 16 and its cathode connected to ground over a diode 20. Control armature 13 of the magneto generator 10 carries a control winding 21, having one end grounded to the chassis and other end connected over another diode 22, with the control electrode 19*a* of the semi-conductor controlled rectifier 19. A voltage dependent resistor 23 as well as a diode 24 is provided in parallel to the switching path of the semi-conductor controlled rectifier 19 in order to protect it.

For the speed limiting operation of the ignition system shown in FIG. 1, the negative voltage halfwaves of the control winding 21 are utilized as speed dependent voltage pulses and are furnished over an electronic control switch constituted by the PNP transistor 25, to the control electrode 19*a* of the semi-conductor controlled rectifier, 19. The collector of this transistor 25 is thus directly connected to the control electrode 19*a* of the semi-conductor controlled rectifier, whereas the collector of the transistor 25 is connected to the ground terminal of the control winding 21 and the base of the transistor 25 is connected over a resistor 26 with the ungrounded terminal of the control winding 21. The semi-conductor controlled rectifier 19 has its cathode connected over a variable resistor 27 with the ungrounded terminal of the control winding 21. In such a circuit, as explained in more detail below, the transistor 25 is capable of being switched in response to the negative voltage pulses of the control winding 21. The base of the transistor 25 is connected over another resistor 28 of high ohm value to the capacitor 16 which is charged periodically by the magneto generator 10.

The manner of operation of the circuits of FIG. 1 is explained below with reference to the time course of the voltage of the control winding 21, and the voltage of the ignition capacitor 16, illustrated in FIG. 2. When the engine is operating, the magnets of the driven pole wheel 11 affect the charging armature 12 and the control armature 13 in such a way that voltage pulses are induced in alternating sequence in the charging winding 12 and in the control winding 21 in turn. The voltage $U_s$ in the control winding 21 has the dependence on the position of the crankshaft of the engine (° KW) shown in FIG. 2. In the upper portion of FIG. 2 the course of the voltage $U_c$ present on the capacitor 16 is plotted against crankshaft position such as it is when the engine is running at medium speed. The threshold voltage $U_a$ of the control path of the semi-conductor controlled rectifier 19 is shown by a dot-dash line.

The positive voltage pulses of the control voltage $U_s$ directly reach the control path of the SCR 19*a* over the diode 22 and put the semi-conductor controlled rectifier into the conducting condition as soon as the threshold voltage $U_a$ is exceeded. The positive output halfwaves of the magneto generator 10 provided by the charging winding 12 over the charging circuit diode 15 is offset from the positive control halfwaves of the control winding 21 by 180° of crankshaft rotation. The capacitor 16 is charged during the positive halfwaves of the charging winding. If after the capacitor 16 is charged a new positive voltage pulse of the control voltage $U_s$ arrives, the semi-conductor controlled rectifier 19 becomes conducting when the threshold voltage $U_a$ is exceeded at its control electrode, this being the ignition timing moment indicated at Zzp in FIG. 2. At this moment a high discharge current suddenly begins to flow in the discharge circuit of the capacitor 16, flowing through the SCR 19, the diode 20, and the primary winding 17*a* of the ignition transformer or spark coil 17. The high voltage pulse thereby induced in the secondary winding 17*b* produces the desired ignition spark in the spark plug 18. The sequence of events above described in the charging circuit, discharge circuit and control circuit of the ignition system are repeated with each full revolution of the pole wheel 11.

When the engine is operated at high speed, as soon as the highest permissible speed is exceeded, the generation of further sparks in the spark plug 18 is impaired by the speed limiting circuit of the ignition system. Not only do the positive voltage pulses of the control winding 21 reach the control electrode 19*a* of the SCR 19, over the diode 22 at the ignition timing moment Zzp, but also, the negative voltage pulses appearing in the control winding 21 before the beginning of each charging halfwave of the charging winding 14 are applied through the transistor 25 to the control path of the SCR 19 in the excessively high speed condition. These negative voltage pulses reach the base-emitter path of the transistor 25 through the resistor 26 and switch the transistor 25 into the conducting condition. When this happens negative voltage pulses reach the control path of SCR 19 before the beginning of a charging halfwave. It is shown on the lower horizontal axis of FIG. 2 that these negative voltage pulses exceed the threshold voltage $U_a$ of the SCR 19 and thus turn on the SCR 19 during a rotation angle $\phi$ of the crankshaft. During that time, a control current from the control winding 21 flows over the switching path of the conducting transistor 25, over the control path of the SCR 19, and over the resistor 27 back to the control winding 21. As the result of the reactive armature effect in the control armature 13 (counter EMF), the control pulses are shifted in the direction of retarded ignition with increasing speed of the engine. When the highest permissible speed is exceeded, the SCR 19 at the beginning of the charging halfwave of the charging armature 12 shown in dashed lines in FIG. 2 is made conducting by the negative voltage pulse of the control voltage $U_s$ that arrives over the transistor 25. The charging halfwave accordingly flows away through the switching path of the SCR 19 and thus prevents a charging of the ignition capacitor 16. Ignition is thereby disabled. The switching path of the SCR 19 can get back into the non-conducting condition only after the halfwave in the charging winding 12 has died away. The sequence of events just described repeats itself with each revolution of the engine so long as the highest permissible speed is exceeded. If the speed decreases as a result of disabling of ignition, so that it is again in the permissible range, the SCR 19 is no longer turned on sufficiently long during the negative voltage pulses of the control winding 21. It is then already in the non-conducting condition the beginning of the positive charging halfwave. The ignition capacitor is again charged and at the ignition timing moment Zzp ignition will be initiated with the next positive voltage pulse of the control voltage $U_s$.

In order to prevent the negative voltage pulses preceding the positive voltage pulses of the control voltage $U_s$ from reaching the control path of the SCR 19 over the transistor 25, and thereby initiating premature ignition, the voltage $U_c$ of the ignition capacitor 16 is applied over the resistor 28 to the base of the transistor 25. By this provision, the base of the transistor 25 is positively biased as soon as a charge is built up on the capacitor 16. The negative voltage pulse above mentioned of the control voltage $U_s$ can thus no longer be effective at the base of the transistor 25 when the capacitor 16 is charged. The transistor 25 remains non-conducting and thus prevents the switching of the SCR 19 by this above-mentioned negative voltage pulse.

Although the invention has been described by way of illustration with reference to a specific embodiment, variations and modifications are possible within the inventive concept.

We claim:

1. Electronically controlled magneto ignition system for an internal combustion engine comprising:

an engine driven magneto generator (10) having a control winding (21) and an energy supply winding (14);

energy storage means (16) for storing the electrical energy of an output halfwave of the energy supply winding of said magneto generator;

energy transformation means including primary and secondary windings, said secondary winding being a high voltage winding;

a semi-conductor controlled rectifier (19) for discharging electrical energy from said storage means through said primary winding, having a switching path and a control path, said control path including a control electrode (19*a*) connected to said control winding (21) through a diode (22) poled so as to connect positive ignition timing pulses from said control winding to said control electrode of said semi-conductor controlled rectifier, and electronic switching means (25) for applying an auxiliary control voltage ($U_x$) to said control electrode (19*a*) of said semi-conductor controlled rectifier (19) in such a manner as to put said semi-conductor controlled rectifier in conducting condition from a time in advance of the generation of said output halfwave of said magneto generator until the end of said output halfwave when a maximum permissible speed is exceeded and thereby to limit engine speed, said electronic switching means (25) being connected to said control winding (21) and to said control electrode (19*a*) of said semi-conductor controlled rectifier in such a way that negative voltage pulses in advance of the beginning of each output halfwave of said magneto generator may cause the switching path of said electronic switching means (25) to affect the control path of said semi-conductor controlled rectifier in a manner similar to the effect of pulses connected through said diode (22).

2. Electronically controlled magneto ignition system as defined in claim 1, in which the cathode of said semi-conductor controlled rectifier (19) is connected over a resistance (27) of a first terminal of said control winding (21) and is connected over a second diode (20) with a second terminal of said control winding.

3. Electronically controlled magneto ignition system as defined in claim 2, in which said electronic switching means (25) is a PNP transistor having its collector connected to said control terminal (19*a*) of said semi-conductor controlled rectifier (19), its emitter connected to said first terminal of said control winding (21) and its base connected over a resistor (26) with said second terminal of said control winding (21).

4. Electronically controlled magneto ignition system as defined in claim 3, in which the base of electrode of said transistor is connected over another transistor (26) to said energy storage means, said energy storage means being a capacitor 16 arranged for being periodically charged by said magneto generator (10).

* * * * *